US008485125B2

(12) United States Patent
Baumann et al.

(10) Patent No.: US 8,485,125 B2
(45) Date of Patent: Jul. 16, 2013

(54) ELECTROSTATIC SPRAYING ARRANGEMENT

(75) Inventors: Michael Baumann, Flein (DE); Frank Herre, Oberriexingen (DE); Juergen Haas, Knittlingen (DE); Harry Krumma, Bonnigheim (DE); Hans-Jurgen Nolte, Besigheim (DE); Marcus Frey, Weil der Stadt (DE); Bernhard Seiz, Lauffen (DE); Herbert Martin, Weinstadt-Beutelsbach (DE); Erwin Bieber, Kirchberg Murr (DE); Torsten Block, Nufringen (DE)

(73) Assignee: Dürr Systems GmbH, Bietigheim-Bissingen (DE)

( * ) Notice: Subject to any disclaimer, the term of this patent is extended or adjusted under 35 U.S.C. 154(b) by 787 days.

(21) Appl. No.: 12/442,161

(22) PCT Filed: Sep. 26, 2007

(86) PCT No.: PCT/EP2007/008382
§ 371 (c)(1),
(2), (4) Date: Nov. 10, 2009

(87) PCT Pub. No.: WO2008/037456
PCT Pub. Date: Apr. 3, 2008

(65) Prior Publication Data

US 2010/0147215 A1 Jun. 17, 2010

(30) Foreign Application Priority Data

Sep. 27, 2006 (DE) ..... 10 2006 045 631
Jan. 31, 2007 (DE) ..... 10 2007 004 819

(51) Int. Cl.
*B05B 5/025* (2006.01)
*B05B 5/053* (2006.01)

(52) U.S. Cl.
USPC ..... 118/629; 118/621; 118/712; 239/690; 239/691

(58) Field of Classification Search
USPC ..... 118/620–640, 321, 323, 704, 712, 118/713; 239/690–708; 427/458–486
See application file for complete search history.

(56) References Cited

U.S. PATENT DOCUMENTS

| | | | | |
|---|---|---|---|---|
| 4,997,130 | A | 3/1991 | Weinstein | |
| 5,218,305 | A * | 6/1993 | Lunzer | 324/457 |
| 5,351,903 | A * | 10/1994 | Mazakas et al. | 239/705 |
| 6,056,215 | A * | 5/2000 | Hansinger et al. | 239/703 |
| 7,056,387 | B2 * | 6/2006 | van der Steur | 118/629 |
| 7,432,495 | B2 | 10/2008 | Baumann | |

(Continued)

FOREIGN PATENT DOCUMENTS

| | | |
|---|---|---|
| DE | 10309143 | 9/2004 |
| EP | 0219409 | 4/1987 |

(Continued)

*Primary Examiner* — Yewebdar Tadesse
(74) *Attorney, Agent, or Firm* — Bejin, VanOphem & Bieneman PLC

(57) ABSTRACT

A transformer arrangement is disclosed for an electrostatic sprayer or in an adjacent moving element of a coating machine. A transformer provides a galvanic isolation between the line arrangement provided for supplying power to the sprayer arrangement, and consumers at high voltage in the sprayer or possibly in the robot arm. This isolation may be provided with an isolating transformer which has a sufficient isolation distance or other isolation device between the primary and secondary circuits.

12 Claims, 2 Drawing Sheets

U.S. PATENT DOCUMENTS

| | | | | |
|---|---|---|---|---|
| 2003/0064167 | A1 | 4/2003 | Mauchle | |
| 2003/0205631 | A1 | 11/2003 | Barron et al. | |
| 2004/0134424 | A1* | 7/2004 | Dobrowolski | 118/323 |
| 2004/0226391 | A1 | 11/2004 | Ucan | |
| 2006/0175439 | A1* | 8/2006 | Steur et al. | 239/703 |
| 2007/0017443 | A1* | 1/2007 | Skelton-Becker et al. | 118/712 |
| 2007/0276538 | A1* | 11/2007 | Kjellsson et al. | 700/245 |

FOREIGN PATENT DOCUMENTS

| | | | |
|---|---|---|---|
| EP | 1232799 | | 8/2002 |
| EP | 1245291 | | 10/2002 |
| EP | 1293308 | | 3/2003 |
| EP | 1394757 | | 3/2004 |
| JP | 06285406 | | 10/1994 |
| JP | 2002361120 | | 12/2002 |
| RU | 2086312 | C1 | 8/1997 |
| RU | 2163515 | C1 | 2/2001 |
| WO | 9908801 | | 2/1999 |
| WO | 02086515 | | 10/2002 |
| WO | 2005110613 | | 11/2005 |
| WO | WO-2005/110613 | | 11/2005 |

* cited by examiner

ELECTROSTATIC SPRAYING ARRANGEMENT

CROSS-REFERENCE TO RELATED APPLICATIONS

This application is a National Phase application claiming the benefit of International Application NO. PCT EP2007/008382, which claims priority to German Patent Application No. 102006045631.9 filed on Sep. 27, 2006, which claims priority to German Patent Application No. DE102007004819.1 filed on Jan. 31, 2007, the complete disclosures of which are hereby incorporated by references in their entireties.

BACKGROUND

The present disclosure relates to a sprayer arrangement for a coating machine for the serial electrostatic coating of workpieces, such as vehicle bodies or parts thereof for example. The sprayer arrangement may in particular include an electrostatic sprayer and the front arm (arm 2) of a coating robot, on which the sprayer is arranged via the customary wrist joint.

Electrostatic sprayers are generally known. In the case of rotary sprayers they contain, in addition to a turbine (i.e. a pneumatic or hydraulic drive) or an electric motor for driving the sprayer head, various components such as e.g. valves, valve terminals, bus connection modules for field bus systems, valve control systems, drive control loops and other controllers of any type, inductive, optical and/or capacitive sensors, high-voltage generators, etc.

In sprayers which operate with direct charging of the coating material, usually the entire sprayer is placed at high voltage so that the coating material is charged by an electrode device containing all the electrically conductive parts with which it comes into contact, such as the sprayer head, paint pipe, screw connections, etc. Alternatively, an external charging of the coating material by means of external electrodes is possible.

An electrostatic rotary sprayer which contains an electric motor controlled by a safety transformer is disclosed in WO 2005/110613. Further information regarding electrostatic sprayers and the components thereof can be found for example in EP 0 219409, EP 1 245291, EP 1 293308 and EP 1 394757.

EP 1 232 799 describes an air-operated sprayer comprising components which can easily be separated from and connected to one another, at the points of separation of which there is a need for just as easily releasable and connectable electric line connections. Instead of the plug-in contacts used previously for this, the line connections in this air-operated sprayer include inductive couplers with, in each case, two flat coils in particular of the pot core type, which are said to be so small that practically no structural modifications are required on the separable parts of the sprayer which can instead be connected by means of plug-in connections.

DE 103 09 143 describes supplying scraper sensors (pig sensors) on a high-voltage scraped paint conveying line with the voltage they require via an isolating transformer, and to transmit the sensor signals from the high-voltage area to an external evaluation circuit via optocouplers.

The use of the high voltage during application generally requires large isolation distances between the components which are at high voltage and those at low potential, some of which may also be located in the arm of a robot serving as the coating machine. However, the space conditions in the sprayer arrangement often do not allow any separation between components at high voltage and components which are at ground or low potential. Consequently, a complete charging of the components in the sprayer arrangement may be necessary.

An electrostatic sprayer contains various components which have to be supplied with electrical power and/or have to receive and/or transmit electrical signals. All the actuators and sensors and other electronic components of the sprayer require an electrical power supply, and all the actuators provided therein require signals coming from outside, while all the sensors and other electronic components deliver, for example, diagnostic data and other signals to the outside, in particular including actual values of externally controlled parameters of the sprayer.

BRIEF DESCRIPTION OF THE DRAWINGS

The present disclosure will be explained in more detail with reference to the drawings, in which.

DETAILED DESCRIPTION

The object of the present disclosure is in particular to achieve an advantageous and problem-free supply of electrical power to components of a sprayer arrangement at high voltage, while achieving potential isolation between an external supply line arrangement and the consumers of the sprayer arrangement.

A transformer arrangement provided at least partially in the sprayer or in an adjacent moving element of the coating machine, such as in particular in the front arm of a coating robot, or possibly even outside the coating machine, as may already be present for example for supplying and controlling an electric drive motor of the sprayer, can advantageously be used for supplying other components of the sprayer arrangement. The transformer can bring about a galvanic isolation between the line arrangement provided for supplying power to the sprayer arrangement, and consumers at high voltage in the sprayer or possibly in the robot arm. This isolation may be provided with an isolating transformer which has a sufficient isolation distance or other isolation device between the primary and secondary circuits. Here, account must be taken of the fact that different components require different supply voltages. By way of example, a frequency controlled drive of the sprayer head requires different voltages and frequencies compared to a consumer which requires only a constant DC voltage (for example 24 V).

According to another aspect, the present disclosure makes it possible to transmit signals which have been transmitted or received by sensors, actuators, control systems and/or other electrical components of the sprayer arrangement to and/or from the sprayer arrangement without any problem, even though these components are at high voltage during operation. This problem is solved in that the signals are transmitted with galvanic isolation. The galvanic isolation can be achieved in various ways, in particular by preferably digital information or data transmission via optical fibers or radio links or as sound signals or even by amplitude or frequency modulation of the supply voltages which are conducted e.g.

from a transformer arrangement with highvoltage isolation to the high-voltage area of the sprayer arrangement.

Figure 1:
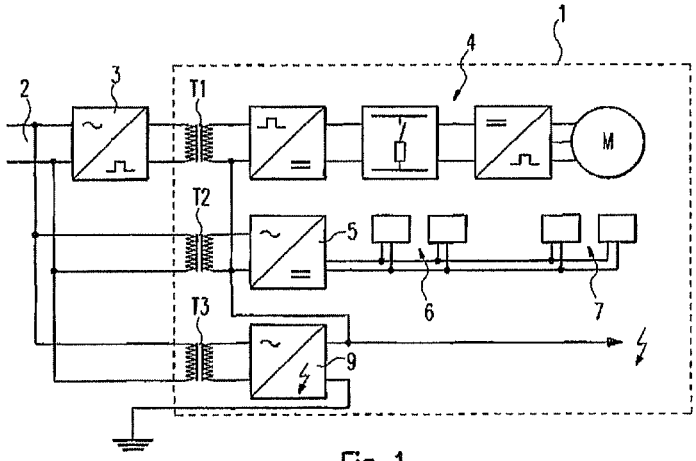
FIG. 1 shows a sprayer arrangement with a transformer arrangement according to an exemplary illustration.

In FIG. 1, there is located in the area 1 the components of an electrostatic rotary sprayer arrangement which are at high-voltage potential during operation (e.g., non-isolated components), namely the actual sprayer or an arrangement consisting of the sprayer, a wrist joint and the front arm of a coating robot which in this case is also at high voltage with essential elements. The front arm may be made from an insulating material in a manner customary per se. Apart from the primary circuits of the transformer arrangement described below, all the components in the area 1 (e.g., non-isolated components) may be at the high-voltage potential including, but not limited to, non-isolated electrical components.

The electrical power supply to this area 1 is achieved by a two-pole or multi-pole external supply line arrangement 2 which, as shown in the drawing, supplies the parallel primary coils of the three transformers T1, T2 and T3 which are designed in a manner known per se as isolating transformers with high-voltage isolation distances (for more than 100 or 150 kY).

Via a transducer 3, the AC voltage of the line arrangement 2 supplies the primary coil of the first transformer T1 with voltage pulses which, on the secondary side, supply the frequency-controlled drive 4 of an electric motor M which is located in the highvoltage area 1 and in the example considered here is provided instead of the airturbines otherwise customary in rotary sprayers for driving the sprayer head and may be located in the sprayer itself or in other cases outside thereof, e.g. in or on the front arm of the robot. The motor M may correspond, for example, to that described in the aforementioned document WO 2005/11 0613 A1.

Accordingly, the AC voltage generated on the secondary side of the transformer T1 can be converted into a DC voltage of, for example, 40 Volts (V), which can optionally be varied in a controlled manner and may be superposed with an AC voltage at a frequency which can be controlled in order to control or regulate the rotary speed of the motor. This DC voltage can then be converted into an AC voltage at a frequency corresponding to the superposed frequency, which supplies the motor M. However, different electrical systems which are known per se can also be used to supply and control the motor M, wherein the rotary speed can be controlled, e.g., by varying the synchronous frequency, and wherein the power supply may also be separate from an e.g. digital rotary speed control.

Instead of the electric motor M, a pneumatic or hydraulic drive for the sprayer head could also be provided. When using an electric motor, it may be advantageous to dimension said motor in such a way that it can simply replace the conventional air turbines in existing sprayers.

On the other hand, the secondary coil of the second transformer T2 serves to supply power to the components including actuators 6, sensors 7 and electronic elements of the sprayer which are located in the high-voltage area 1. As shown in the drawing, the AC voltage generated by the transformer T2 can be converted by a transducer 5 into a DC supply voltage. Typical examples of the components which are shown only schematically at 6 and 7 are actuators such as control and drive circuits for valves and flow, rotary speed and other regulating circuits and also sensors for instance for the switching position of valves, rotary speed, flow rate, temperature, pressure of the coating material, etc. The actuators considered here may also include for example further electric or other motors for instance as a metering pump drive.

In other exemplary illustrations, a DC voltage generated in the motor control system, such as e.g. the drive 4, could also be used to supply power to the sensors and actuators. Moreover, it is possible in other cases to use electric batteries to supply power to individual sensors and/or actuators, or possibly also to use other separate power sources such as fuel cells for example. However, supplying power to the components of the sprayer by means of a transformer arrangement which is present in any case for other purposes, such as in particular an electric drive motor, has the advantage that the power supply expenditure is reduced to a minimum.

The secondary coil of the third transformer T3 supplies a transducer 9 which generates from the input AC voltage the high voltage which is required for the electrostatic charging of the coating material, or supplies a high-voltage generator (not shown) of the sprayer. For the direct or external charging of the coating material, the high voltage is applied to the internal or external electrode arrangements (not shown) which are customary in the case of electrostatic sprayers.

Apart from the sensors and actuators of the sprayer, the transformer arrangement described herein could also be used to supply further components of the application technique which are even located outside the sprayer, such as actuators and sensors of the application technique which are located elsewhere on the coating machine and may be at high-voltage potential or at low or ground potential.

The transformer arrangement may also be utilized to supply power to components which, depending on the system, may be at high voltage or ground potential, such as, e.g. color changers. The transformer arrangement may optionally supply, with the respectively required electrical power, all the application-related components present on a robot.

If, for the transformer arrangement, relatively heavy standard constructions are installed as independent components in the sprayer or in the robot arm for example of a painting robot, these might impair the movement dynamics thereof. It may therefore be more advantageous to integrate the transformer or a transformer coil in the body of the robot arm in such a way that it serves as a supporting element of the robot arm and brings about or at least contributes to the necessary stiffness thereof. Consequently, the total weight of the sprayer arrangement including the robot arm is not significantly increased by the transformer.

Figure 2:
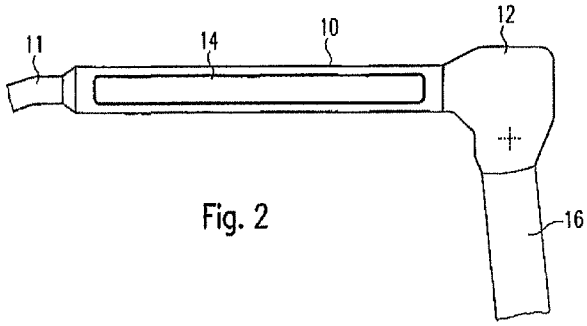
FIG. 2 shows a schematic diagram of one exemplary illustration of a transformer arrangement.

One exemplary illustration of this is shown schematically in FIG. 2, in which it is possible to see a pivotably mounted robot arm 10, at one end (the left-hand end) of which there is mounted via a wrist joint the sprayer denoted 11, while located at its opposite end is the customary axle housing 12 with the hand axle motors necessary for the sprayer movements. The housing 12 may be placed at low or ground potential.

The outer housing of the robot arm 10 is formed or supported on its inner side by a transformer coil 14 which is adapted to the geometric shape of the robot arm and which thus brings about the necessary mechanical strength of the robot arm 10. As already mentioned, the robot arm 10 including the transformer coil 14, which in this example serves as the secondary coil, may be at high-voltage potential. The high voltage-isolated primary coil of the transformer, which is connected to the external supply line arrangement 2 (shown in FIG. 1), may be in inductive range advantageously in the housing 12 or in the vicinity thereof at a location in the arm 10 at low or ground potential.

It is also conceivable to install the transformer arrangement considered here at least partially in the other (rear) robot arm 16 or in a component which is separate from the arms 10 and 16 and which is mounted on the robot so as to travel along therewith (axle 7), wherein the secondary side which is galvanically isolated from the primary side by the high-voltage isolation device, as in the other examples that can be galvanically connected to the elements to be supplied which are at high voltage.

The transmission of control and sensor signals to and from the actuators and sensors located in the high-voltage area 1 (FIG. 1) must take place in a galvanically isolated 5 manner in order to prevent any influencing by the high voltage. To this end, the possibilities of optical transmission or a radio link are considered below, which may be advantageous even independently of the above-described power supply by means of a transformer.

Figure 3:
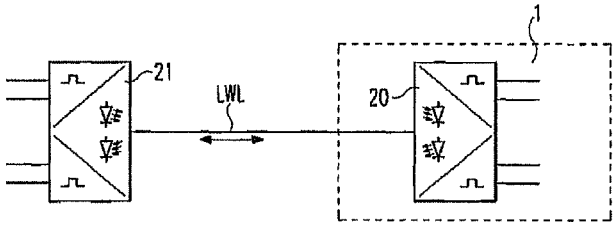
FIG. 3 shows a basic diagram of signal transmission via optical fibers.

As shown in FIG. 3, provided in the high-voltage area 1 is an electrical-to-optical transducer arrangement 20 which converts e.g. digital sensor signals produced by the sensors into optical signals and incoming optical control signals into e.g. digital control signals. The optical sensor and control signals are transmitted bidirectionally via an optical waveguide arrangement OWG between the transducer arrangement 20 and an external transducer arrangement 21 located outside the high-voltage area.

The transducer arrangement 21 can convert the optical signals back into electrical signals, e.g., digital, signals. The optical transmission takes place in a potential-free manner, as is known. The signal conversion from optical to electrical signals and vice versa at the respective end of the fiberoptic cable forming the optical waveguide arrangement OWG can take place using commercially available components. It is possible for both individual signals and also complex bus signals to be transmitted, which allows the use of field bus systems and components thereof which are known per se.

Figure 4:
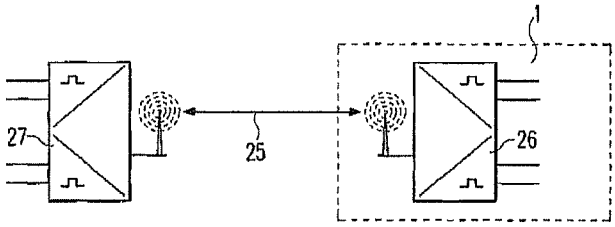
FIG. 4 shows a basic diagram of signal transmission via a radio link.

The data into and out of the high-voltage area 1 can also be transmitted via a radio link, as shown in FIG. 4. There, a radio link 25 is located between a transducer arrangement 26 located in the high-voltage area 1, which converts the 25 aforementioned sensor and control signals into radio signals, and an external transducer arrangement 27, which converts the radio signals back into electrical signals. Use may be made of commercially available systems which set up radio links for example via Bluetooth or using the wireless networks known as WLANs. In particular, the transmission of large quantities of data is possible with these. It is also possible to transmit the data to an area outside the robot, as a result of which the necessary cable connections in the robot can be reduced to a minimum. As is known, signal transmission via a radio link also takes place in a potential-free manner. The signal conversion at the respective end of the radio link 25 into electrical signals or radio signals may be carried out in a manner known per se using customary transmitting and receiving components. In this case too, both individual signals and complex bus signals can be transmitted, so that the use of known field bus systems and components thereof is possible. Signal transmission via radio also takes place in a bidirectional manner, i.e. signals are transmitted in both directions on the transmission medium in question.

Bluetooth is a generally known industry standard according to IEEE 802.15.1 for the wireless radio networking of devices over a relatively short distance of up to approximately 100 m. The networked devices can transmit in the ISM band (Industrial, Scientific and Medical band) between 2.402 GHz and 2.480 GHz. To achieve robustness against interference in the same frequency band, use is made of a frequency hopping process, in which the frequency band is divided into a large number (79) of frequency stages, e.g. at intervals of 1 MHz, which are changed up to 1600 times per second. There are also data packets for which the frequency is changed less often. At the lower and upper end, there is in each case a frequency band as a safety band for adjacent frequency ranges. By means of EDR (Enhanced Data Rate), data can be transmitted at approximately 2.1 Mbit/s. At present, a Bluetooth device can maintain up to seven connections simultaneously, the devices involved sharing the available bandwidth. Different types of error handling are available: ⅓ FEC (Forward Error Control) with two-times repetition of each bit, ⅔ FEC with use of a generator polynomial for coding 10 bits into 15 bits, and ARQ (Automatic Repeat Request), wherein a data packet is repeated until a positive acknowledgement is received or a time limit is exceeded. On the other hand, WLAN 25 (Wireless Local Area Network) refers to networks according to IEEE 802.11, which can be operated in the infrastructure mode or in the ad-hoc mode. In the infrastructure mode, the individual network nodes are coordinated by a base station, via which a connection to wired networks can easily be established. In the ad-hoc mode, no station is particularly distinguished but rather all stations are equal. Ad-hoc networks can be set up quickly and without great outlay. For WLANs, methods of increasing the security of data transmission are also known.

In order to ensure secure data transmission via radio, for example using WLAN or also using Bluetooth, it is possible inter alia to apply the known method referred to as frequency spreading, in which a narrowband signal is converted into a broadband signal. The transmission energy, which was previously concentrated in a small frequency range, is in this case distributed over a larger frequency range. One advantage obtained as a result is a greater robustness against narrowband interference. Furthermore, frequency spreading is used in digital technology to reduce the spectral density of the clock signals and thus to achieve better electromagnetic compatibility. The method can be carried out in various ways. In the DSSS (Direct Sequence Spread Spectrum) method, the useful data are linked by exclusive-OR (XOR) to a code and then modulated to the bandwidth. This method is generally applied in combination with the COMA technique and can be used in particular in the case of WLANs according to the standard IEEE 802.11 and the mobile radio standard UMTS. In frequency spreading methods based on frequency hopping, the available bandwidth is divided between many channels of smaller bandwidth in the context of frequency multiplexing. This method can be used inter alia in the case of Bluetooth.

In general, it is advantageous to monitor the described signal transmission via the optical waveguide arrangement OWG or the radio link 25 electronically by means of a system which includes a security software program which monitors the transmission path and checks the transmitted information with regard to plausibility. One possibility consists for example in transmitting the given data packet, e.g. in a frequency modulated manner, multiple times, e.g. 5 times, during the information data transmission and checking at the other end whether at least two identical data packets arrive and therefore the radio or other transmission path is in order. In the event of errors, security-related components of the sprayer arrangement and/or of the transmission path can be switched off in order to protect objects and persons. By means of an error report, the operating staff can be informed about the state that has been detected. In particular, the following types of monitoring may be constantly active: checking of the optical transmission path or radio link; plausibility of the transmitted information (protocols); and switch-off function of the entire system in the event of an error and informing of the operating staff.

Instead of the described optical or radio transmission paths, there is also the possibility of a preferably bidirectional acoustic signal transmission. For this transmission technique, which is likewise potential-free (and has already been proposed per se for example for controlling the rotary speed of sprayers), sound level signals can be generated using microphones, conducted through a tube and converted back into electrical signals at the reception point.

A further possibility for the potential-free transmission of control signals in the highvoltage area of a sprayer arrangement consists in superposing on the input voltage of the above-described transformer arrangement the signal components containing the control information, which can be filtered out again on the secondary side and can be used as control signals for components located in the high-voltage area. The superposed signal components may be for example an optionally digital frequency or amplitude modulation of the input voltage. Instead, it is also possible to transmit an AC voltage signal, which is controlled according to a desired control function and is transmitted separately from the input voltage of the transformer arrangement (T1, T2, T3) provided for other functions, into the high-voltage area via a separate transformer with high-voltage isolation. With each of these possibilities, it is also possible in particular for the rotary speed of the optionally electric drive motor of the sprayer to be controlled and/or to be regulated in the closed control loop. In a manner similar to the described transmission of control signals into the sprayer arrangement, sensor signals can also be transmitted from the sprayer arrangement into an area at low or ground potential inside or outside the coating machine.

As a modification to the described example of embodiment, it is also possible to arrange the transformer arrangement, which is provided for the electrical power supply to the sprayer arrangement, outside the painting robot, e.g. including in a cabinet outside the spray booth. This might be advantageous for example in order to avoid explosion control problems. The high-voltage isolation which is then required between the transformer and the sprayer can be embodied in a manner known per se to the person skilled in the art within the line arrangement leading to the painting robot or sprayer.

The invention claimed is:

1. A sprayer arrangement for a coating machine for the serial electrostatic coating of workpieces, comprising:

an electrostatic sprayer including a device for charging a coating material to a high voltage, the electrostatic sprayer comprising a high voltage area which is charged to the high voltage during operation and in which there are located non-isolated electrical components, including at least one actuator and at least one sensor, wherein signals in communication with the non-isolated electrical components of the sprayer arrangement are galvanically isolated from the high voltage area.

2. The sprayer arrangement according to claim 1, further comprising at least one optical fiber configured to provide a galvanically isolated transmission signal to the non-isolated electrical components.

3. The sprayer arrangement according to claim 1, further comprising a radio link configured to provide a galvanically isolated transmission signal to the non-isolated electrical components.

4. The sprayer arrangement according to claim 3, wherein the radio link includes one of a Bluetooth system and a WLAN system.

5. The sprayer arrangement according to claim 1, wherein a bidirectional signal transmission takes place on a same transmission path that includes the non-isolated electrical components.

6. The sprayer arrangement according to claim 1, wherein the signals in communication with the non-isolated electrical components are superposed with a voltage of a transformer arrangement.

7. The sprayer arrangement according to claim 1, further comprising a system for checking the correctness of the signals.

8. The sprayer arrangement according to claim 1, further comprising an electronic monitoring device including monitoring software configured to monitor a transmission path, the electronic monitoring device configured to generate an error message when an error is detected by the monitoring software.

9. The sprayer arrangement according to claim 1, wherein the non-isolated electrical components include a control system.

10. The sprayer arrangement according to claim 1, wherein the non-isolated electrical components further comprises a transducer.

11. The sprayer arrangement according to claim 10, wherein the transducer comprises an optical transducer.

12. The sprayer arrangement according to claim 10, wherein the transducer comprises a wireless transducer.

* * * * *